US009653837B2

(12) United States Patent
Nooner et al.

(10) Patent No.: US 9,653,837 B2
(45) **Date of Patent: *May 16, 2017**

(54) ELECTRICAL CORD CONNECTION COVERING TECHNIQUES

(71) Applicant: Midwest Innovative Products, LLC, Frankfort, IL (US)

(72) Inventors: Bryan Nooner, Orland Park, IL (US); Robert Zajeski, Homer Glen, IL (US)

(73) Assignee: Midwest Innovative Products, LLC, Frankfort, IL (US)

( * ) Notice: Subject to any disclaimer, the term of this patent is extended or adjusted under 35 U.S.C. 154(b) by 3 days.

This patent is subject to a terminal disclaimer.

(21) Appl. No.: 15/158,842

(22) Filed: May 19, 2016

(65) Prior Publication Data

US 2016/0268724 A1 Sep. 15, 2016

Related U.S. Application Data

(63) Continuation of application No. 15/137,131, filed on Apr. 25, 2016, now Pat. No. 9,413,101, which is a continuation of application No. 14/864,040, filed on Sep. 24, 2015, now abandoned, which is a continuation of application No. 29/483,894, filed on (Continued)

(51) Int. Cl.

| | |
|---|---|
| ***H01R 13/52*** | (2006.01) |
| ***H01R 13/516*** | (2006.01) |
| *H01R 103/00* | (2006.01) |
| *H01R 24/30* | (2011.01) |

(52) U.S. Cl.

CPC ..... *H01R 13/52* (2013.01); *H01R 13/516* (2013.01); *H01R 13/5208* (2013.01); *H01R 13/5213* (2013.01); *H01R 24/30* (2013.01); *H01R 2103/00* (2013.01)

(58) Field of Classification Search

CPC ..... H01R 13/5219; H01R 13/5208; H01R 13/5213

See application file for complete search history.

(56) References Cited

U.S. PATENT DOCUMENTS

| | | | |
|---|---|---|---|
| 3,014,194 | A | 12/1961 | Berglund |
| 3,344,393 | A | 9/1967 | Hendee |

(Continued)

OTHER PUBLICATIONS

PCT, Notification of Transmittal of The International Search Report and The Written Opinion of the International Searching Authority, or the Declaration, in Application No. PCT/US2012/052795, dated Nov. 14, 2012. (12 pages).

(Continued)

*Primary Examiner* — James Harvey

(74) *Attorney, Agent, or Firm* — McAndrews, Held & Malloy, Ltd.

(57) ABSTRACT

An electrical cord covering system includes a first housing portion and a second housing portion. The housing portions each include compression portions around their respective rims. The compression portions each have two recessed areas. When the housing portions are in a closed position a hollow region is formed to cover mated electrical cord plugs. A rim seal is formed with the compression portions. Two apertures are formed in the rim seal from the recessed apertures. The cable apertures form seals against electrical cords running to the electrical cord plugs.

9 Claims, 9 Drawing Sheets

Related U.S. Application Data

Mar. 4, 2014, now Pat. No. Des. 753,606, which is a continuation of application No. 13/772,859, filed on Feb. 21, 2013, now Pat. No. 8,870,587, which is a continuation-in-part of application No. 13/597,590, filed on Aug. 29, 2012, now Pat. No. 8,702,440.

(56) References Cited

U.S. PATENT DOCUMENTS

| | | | | |
|---|---|---|---|---|
| 4,066,321 | A | 1/1978 | Villazon | |
| 5,135,409 | A | 8/1992 | Thompson | |
| 5,217,387 | A | 6/1993 | Hull | |
| 5,259,782 | A | 11/1993 | Giffin | |
| 5,299,951 | A * | 4/1994 | Blaetz | H01R 13/5208 439/367 |
| 5,551,888 | A | 9/1996 | Rhodes, Sr. | |
| 5,561,269 | A | 10/1996 | Robertson | |
| 5,594,210 | A | 1/1997 | Yabe | |
| 5,755,588 | A | 5/1998 | Sweatman | |
| 3,030,601 | A | 12/1998 | Krebs | |
| 5,844,171 | A | 12/1998 | Fitzgerald | |
| 6,250,946 | B1 | 6/2001 | Tardy | |
| 7,189,100 | B1 | 3/2007 | Colbourne | |
| 7,285,725 | B1 | 10/2007 | Saman | |
| 7,465,182 | B1 | 12/2008 | McDonald | |
| 7,553,181 | B1 | 6/2009 | Van Dalinda, III | |
| 2005/0131154 | A1 * | 6/2005 | Cai | C08L 23/10 525/192 |
| 2005/0147361 | A1 | 7/2005 | Hovland | |

OTHER PUBLICATIONS

PCT, Notification Concerning Transmittal of International Preliminary Report on Patentability, in Application No. PCT/US2012/052795, dated Mar. 13, 2014. (6 pages).

PCT, Notification of Transmittal of The International Search Report and The Written Opinion of the International Searching Authority, or the Declaration, in Application No. PCT/US2014/012692, dated Jan. 16, 2015. (10 pages).

PCT, Notification Concerning Transmittal of International Preliminary Report on Patentability in Application No. PCT/US2014/012692, dated Sep. 3, 2015 (8 pages).

Canadian Intellectual Property Office, Requisition by Examiner, Application No. 2,844,133, dated Jul. 30, 2015 (3 pages).

* cited by examiner

ELECTRICAL CORD CONNECTION COVERING TECHNIQUES

CROSS REFERENCE TO RELATED APPLICATIONS

This application is a continuation of U.S. patent application Ser. No. 15/137,131, filed Apr. 25, 2016, which is a continuation of U.S. patent application Ser. No. 14/864,040, filed Sep. 24, 2015, which is a continuation of U.S. patent application Ser. No. 29/483,894, filed Mar. 4, 2014, now U.S. Design Pat. No. D753,606, which is a continuation of U.S. patent application Ser. No. 13/772,859, filed on Feb. 21, 2013, now U.S. Pat. No. 8,870,587, which is a continuation-in-part of U.S. patent application Ser. No. 13/597,590, filed on Aug. 29, 2012, now U.S. Pat. No. 8,702,440, which claims priority to U.S. Patent Application Ser. No. 61/528,456, filed on Aug. 29, 2011, the entireties of which are herein incorporated by reference.

FEDERALLY SPONSORED RESEARCH OR DEVELOPMENT

[Not Applicable]

JOINT RESEARCH AGREEMENT

[Not Applicable]

SEQUENCE LISTING

[Not Applicable]

BACKGROUND OF THE APPLICATION

Generally speaking, this application discloses techniques relating to weatherproofing plug connections for electrical cords, such as extension cords or decorative lighting cords.

It may be desirable to keep moisture from interfering with electrical cord plug connections. If such a connection is corrupted by moisture, short circuits to ground may occur causing a potentially dangerous condition or causing circuit breakers, fuses, or ground-fault interrupt protection circuits to prevent the flow of current through the electrical cord. For example, outdoor holiday lighting often involves the use of multiple plug connections in an environment with unfavorable environmental conditions (for example, snow, melting snow, fog, sleet, freezing rain, rain, extreme temperatures, salt, etc.).

One attempted solution to these problems is shown in FIGS. 4A-4C. A gasket is placed between male and female cord plugs and a plastic housing is connected around the plug connection. The gasket mechanism may be relatively small (for example, about the size of a quarter or a little thicker than a penny) and may not be sufficiently durable under unfavorable environmental conditions, especially when exposed to a substantial amount of moisture. As another example, the plastic housing may not be effective at keeping out moisture (for example, moisture may be able to penetrate through the housing connections and through the holes where the cord cables run).

Figure 1A:
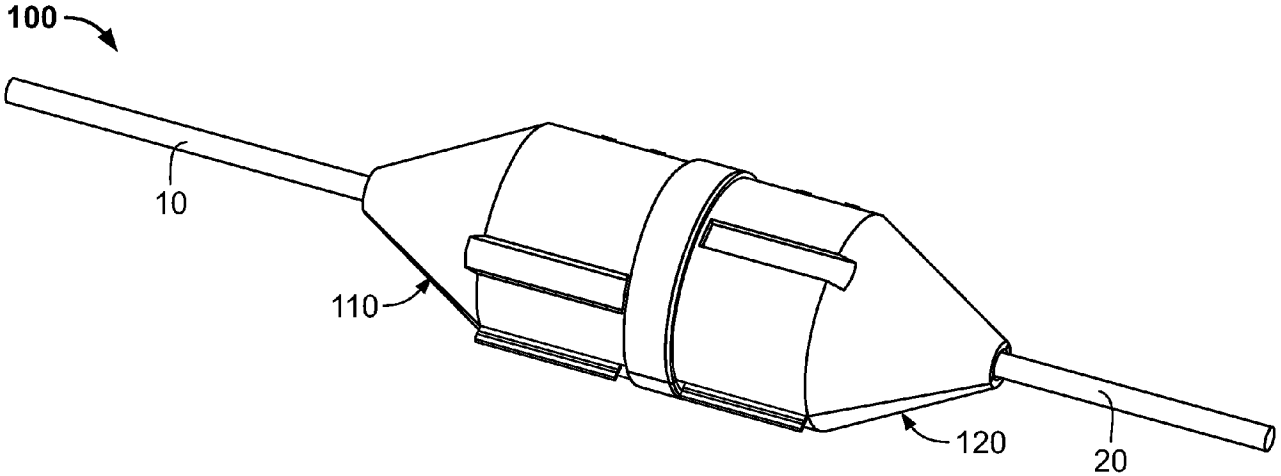
FIG. 1A shows a perspective view of a system for covering a connection of electrical cords in which two covering portions are mated, according to techniques of the present application.
Figure 1B:
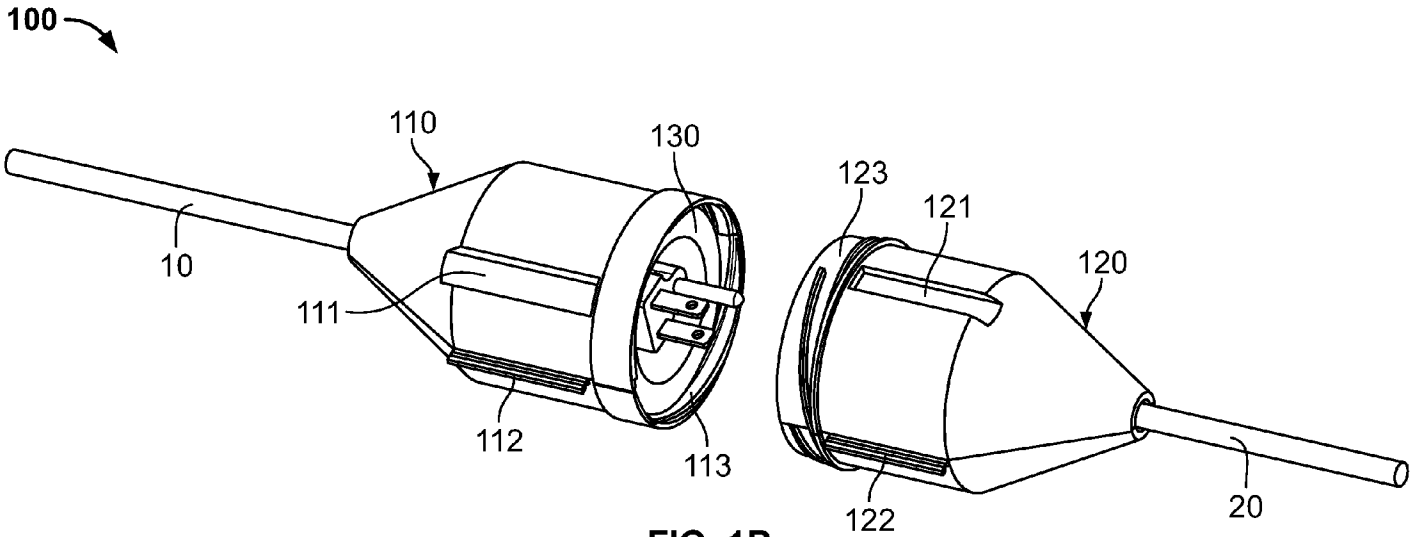
FIG. 1B shows a perspective view of a system for covering a connection of electrical cords in which two covering portions are not mated, according to techniques of the present application.
Figure 1C:
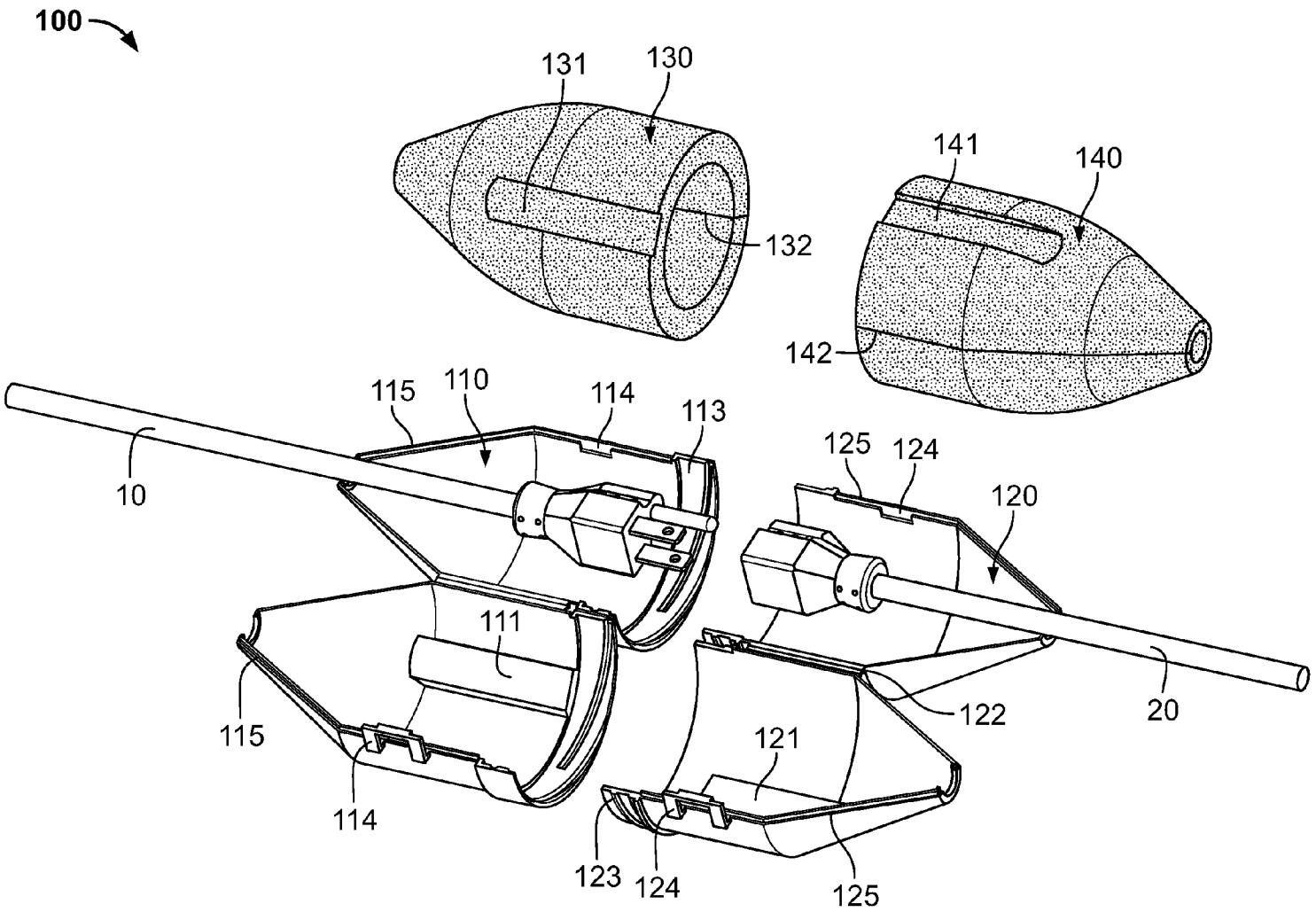
FIG. 1C shows a perspective view of a system for covering a connection of electrical cords in which two covering portions are not mated, according to techniques of the present application.

The foregoing summary, as well as the following detailed description of certain techniques of the present invention, will be better understood when read in conjunction with the appended drawings. For the purposes of illustration, certain techniques are shown in the drawings. It should be understood, however, that the claims are not limited to the arrangements and instrumentality shown in the attached drawings. Furthermore, the appearance shown in the drawings is one of many ornamental appearances that can be employed to achieve the stated functions of the system.

DETAILED DESCRIPTION OF THE APPLICATION

FIGS. 1A-1E show a system 100 for covering an electrical cord connection, according to techniques of the present application. The system 100 may include a first covering portion 110, a second covering portion 120, a first compression portion 130, and a second compression portion 140. The covering portions 110, 120 may be plastic. The covering portions 110, 120 may have a funnel-like shape. The compression portions 130, 140 may be foam and may have a funnel-like shape.

The first covering portion 110 may have an interior region, a cable aperture, a plug aperture, and a mating portion 113 proximate to the plug aperture. The interior region may house a portion of a cable 10 and a plug 11 of a first electrical cord. The cable aperture may accommodate the cable 11 of the first electrical cord. The plug aperture may be arranged to permit the plug 11 of the first electrical cord to mate with a plug 21 of a second electrical cord. The first covering portion 110 may also have a hinge 112 (for example, a living hinge), a sealing ridge 115, a keyway 111, and a securing portion 114. It should be understood that references to components or portions of the first covering portion 110 may refer to one or more of such components or portions (for example, hinge 112, sealing ridge 115, keyway 111, and securing portion 114). The hinge 112 and securing portion 114 may allow the first covering portion 110 to be shaped as a clam shell with two casing halves. The securing portion 114 may allow the two casing halves to securely open and close to seal the sealing ridge 115. The securing portion 114 may be integrated into the first covering portion 110 and may include snap locks.

The second covering portion 120 may have an interior region, a cable aperture, a plug aperture, and a mating portion 123 proximate to the plug aperture. The interior region may house a portion of a cable 20 and a plug 21 of a second electrical cord. The cable aperture may accommodate the cable 20 of the second electrical cord. The plug aperture may be arranged to permit the plug 21 of the second electrical cord to mate with a plug 11 of the first electrical cord. The second covering portion 120 may also have a hinge 122 (for example, a living hinge), a sealing ridge 125, a keyway 121, and a securing portion 124. It should be understood that references to components or portions of the second covering portion 120 may refer to one or more of such components or portions (for example, hinge 122, sealing ridge 125, keyway 121, and securing portion 124). The hinge 122 and securing portion 124 may allow the second covering portion 120 to be shaped as a clam shell with two casing halves. The securing portion 124 may allow the two casing halves to securely open and close to seal the sealing ridge 125. The securing portion 124 may be integrated into the second covering portion 120 and may include snap locks.

The first compression portion 130 may include an access slit 132 and a keyway 131. The first compression portion 130 may nest (at least partially) within the interior region of the first covering portion 110. The first compression portion 130 may surround the portion of the cable 10 and the plug 11 of the first electrical cord accommodated by the interior region of the first covering portion 110. The access slit 132 may facilitate this surrounding arrangement by allowing the electrical cord 10 to pass through a lateral wall of the first compression portion 130.

The second compression portion 140 may include an access slit 142 and a keyway 141. The second compression portion 140 may nest (at least partially) within the interior region of the second covering portion 120. The second compression portion 140 may surround the portion of the cable 20 and the plug 21 of the second electrical cord accommodated by the interior region of the second covering portion 120. The access slit 142 may facilitate this surrounding arrangement by allowing the electrical cord 20 to pass through a lateral wall of the second compression portion 140.

The compression portions 130, 140 may include foam such as closed-cell foam, which may inhibit or prevent the absorption of liquids such as water. The foam may repel water, which may bead once hitting the foam and then roll off of the foam. Due to the compressibility of the foam, the compression portions 130, 140 may be self-adjusting, thereby facilitating the formation of seals around different size cords or wires, such as 14, 16, 18, 20, 22, or 24 gauge wires or cords.

Figure 1D:
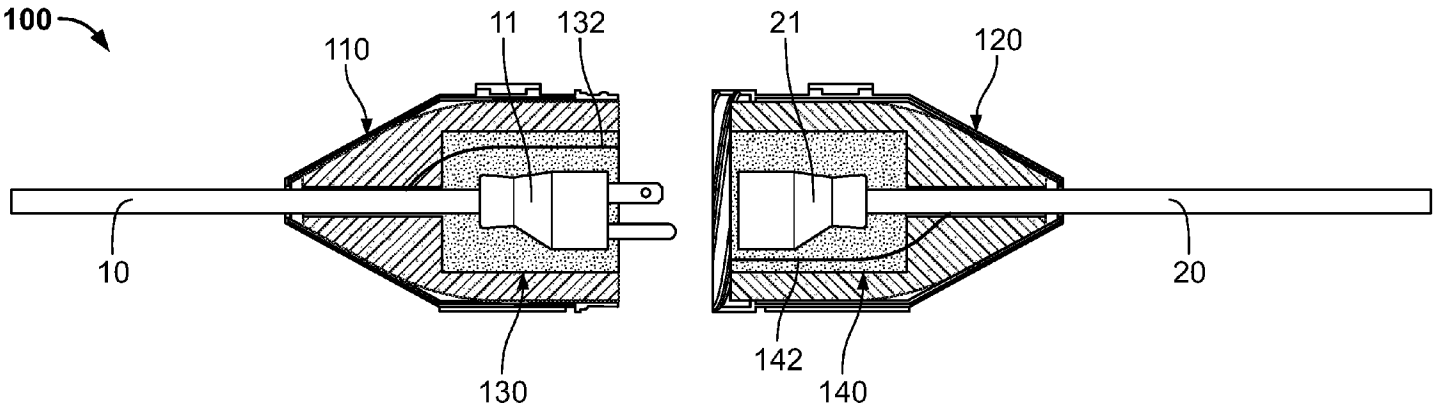
FIG. 1D shows a cross-sectional view of a system for covering a connection of electrical cords in which two covering portions are not mated, according to techniques of the present application.
Figure 1E:
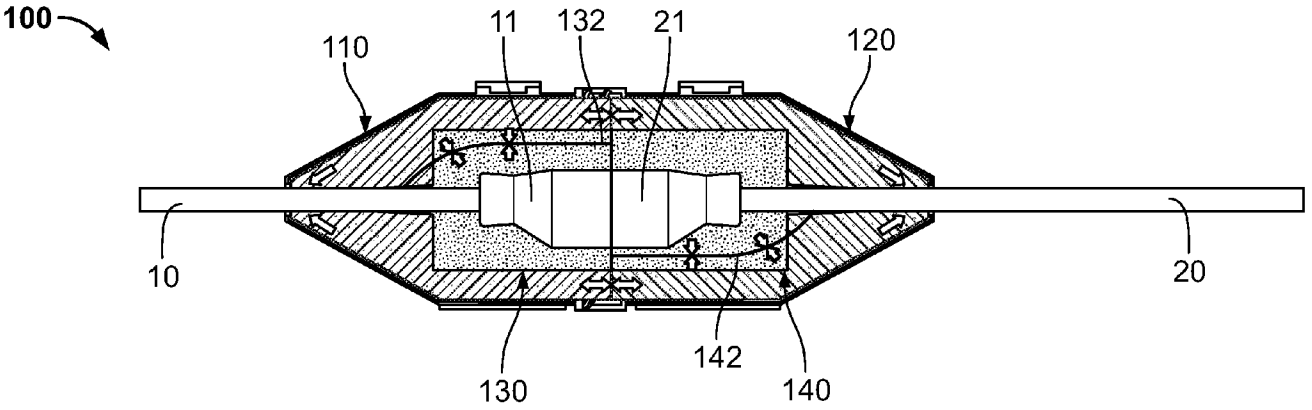
FIG. 1E shows a cross-sectional view of a system for covering a connection of electrical cords in which two covering portions are mated, according to techniques of the present application.

FIG. 1D shows a cross-sectional view of the system 100 before the covering portions 110, 120 are mated. FIG. 1E shows a cross-sectional view of the system 100 after the covering portions 110, 120 are mated. After mating via the mating portions 113 and 123, the first compression portion 130 may compress (as illustrated by the arrows in FIG. 1E) and fill in voids in the interior region of the first covering portion 110 (for example, near the cable aperture). This compression (for example, radial compression) may also form seals at the cable aperture and at the access slit 132. Similarly, the second compression portion 140 may compress and fill in voids in the interior region of the second covering portion 120. This compression may also form seals at the cable aperture and at the access slit 142.

Additionally, when the mating portions 113, 123 are mated, the first and second compression portions 130, 140 may compress against each other and a seal may be formed at the plug apertures and around the mated plugs 11, 21. The mating portions 113, 123 may mate by screwing (for example, ¼ turn). As the covering portions 110, 120 are connected they may exert a radial compression force upon the compression portions 130, 140 causing them to fill in the voids around the cables 10, 20 and the other openings along the compression portions 130, 140, resulting in a substantially water or weather resistant seal around the electrical connection between the plugs 11, 21. The compression portions 130, 140 may be slightly larger than the respective covering portions 110, 120. This may facilitate compression once the first and second covering portions 110, 120 are mated.

The keyways 111, 121 of the covering portions 110, 120 may also facilitate preventing moisture from seeping into the electrical connection between the plugs 11, 21. In order to have the compression portions 130, 140 nest in a particular orientation to the respective covering portions 110, 120, keyways 131, 141 may be employed. The compression portions 130, 140 may have keyways 131, 141 that match the respective keyways 111, 121 on the covering portions 110, 120. By maintaining a particular orientation of the compression portions 130, 140 with respect to the covering portions 110, 120, the slits 132 may be positioned or rotated away from the sealing ridges 115 of the covering portions 110, 120. The keyways 111, 121, 131, 141 may also provide an indicator whether the covering portions 110, 120 are mated or not.

The system shown in FIGS. 1A-1E may be used in the following manner. The cables 10, 20 and plugs 11, 21 of the first/second electrical cords are placed in the respective first/second compression portions 130, 140. This is facilitated by the slits 132, 142. The first/second compression portions 130, 140 are then placed in the respective first/second covering portions 110, 120. The keyways 111, 121, 131, 141 of the compression portions 130, 140 and the covering portions 110, 120 maintain a desirable orientation to prevent the slits 132, 142 from lining up with the sealing ridges 115, 125. The covering portions 110, 120 are closed and secured around the compression portions 130, 140. The covering portions 110, 120 are screwed together. This causes the compression portions 130, 140 to compress. The compression causes various seals to be made—for example, seals around the cable apertures, plug apertures, sealing ridges, etc. Additionally, the compression portions 130, 140 compress against each other causing an additional compression seal.

FIGS. 2A-2E show a system 200 for covering an electrical cord connection, according to techniques of the present application. The system 200 may include a first covering portion 210, a second covering portion 220, a compression portion 230. The covering portions 210, 220 may be plastic. The covering portions 210, 220 may have a funnel-like shape. The compression portion 230 may be foam and may have one or more funnel-like shapes. The compression portion 230 may be formed of two compression portions, such compression portions 130, 140.

The first covering portion 210 may have an interior region, a cable aperture, a plug aperture, and a mating portion 213 proximate to the plug aperture. The interior region may house a portion of a cable 10 and a plug 11 of a first electrical cord. The cable aperture may accommodate the cable 10 of the first electrical cord. The plug aperture may be arranged to permit the plug 11 of the first electrical cord to mate with a plug 21 of a second electrical cord. The first covering portion 210 may also have a hinge 212 (for example, a living hinge), a sealing ridge 217, and a securing portion 214. It should be understood that references to components or portions of the first covering portion 210 may refer to one or more of such components or portions (for example, hinge 212, sealing ridge 217, and securing portion 214). The hinge 212 and securing portion 214 may allow the first covering portion 210 to be shaped as a clam shell with two casing halves. The securing portion 214 may allow the two casing halves to securely open and close to seal the sealing ridge 217. The securing portion 214 may be integrated into the first covering portion 210 and may include snap locks.

The second covering portion 220 may have an interior region, a cable aperture, a plug aperture, and a mating portion 223 proximate to the plug aperture. The interior region may house a portion of a cable 20 and a plug 21 of a second electrical cord. The cable aperture may accommodate the cable 20 of the second electrical cord. The plug aperture may be arranged to permit the plug 21 of the second electrical cord to mate with a plug 11 of the first electrical cord. The second covering portion 220 may also have a hinge 222 (for example, a living hinge) a sealing ridge 227, and a securing portion 224. It should be understood that references to components or portions of the second covering portion 220 may refer to one or more of such components or portions (for example, hinge 222, sealing ridge 227, and securing portion 224). The hinge 222 and securing portion 224 may allow the second covering portion 220 to be shaped as a clam shell with two casing halves. The securing portion 224 may allow the two casing halves to securely open and close to seal the sealing ridge 227. The securing portion 224 may be integrated into the second covering portion 220 and may include snap locks.

The first and second covering portions 210, 220 may include other connectors, such as radial lock(s). The radial locks may include nubs 215 and mating tabs 225 (for example, four pairs of nubs 215 and tabs 225). While the nubs 215 are depicted on the first covering portion 210 and the mating tabs 225 are depicted on the second covering portion 220, the reverse may also be possible.

Figure 3A:
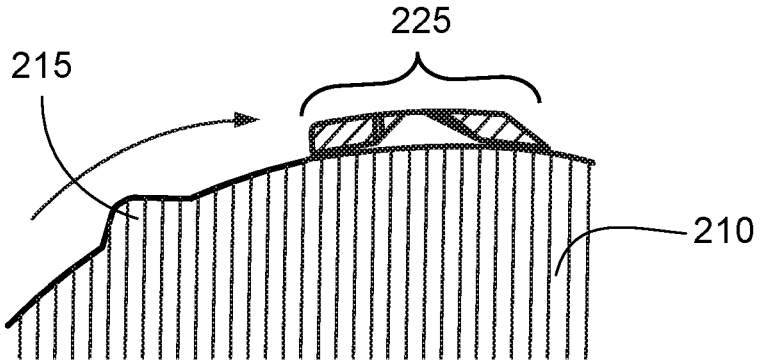
FIG. 3A shows a cross-sectional view of a radial locking system, according to techniques of the present application.
Figure 3B:
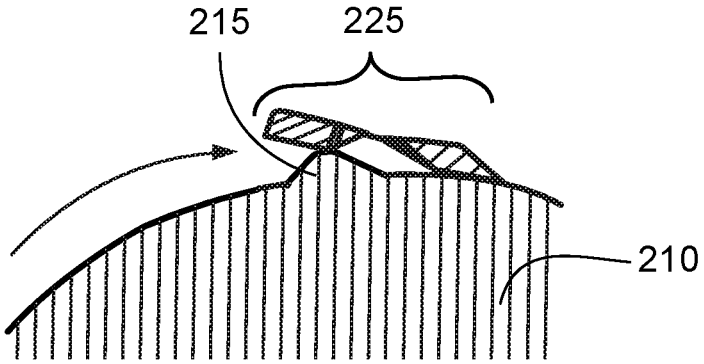
FIG. 3B shows a cross-sectional view of a radial locking system, according to techniques of the present application.
Figure 3C:
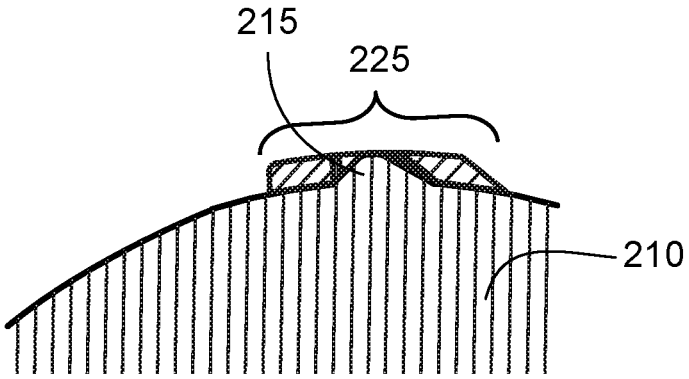
FIG. 3C shows a cross-sectional view of a radial locking system, according to techniques of the present application.
Figure 4A:
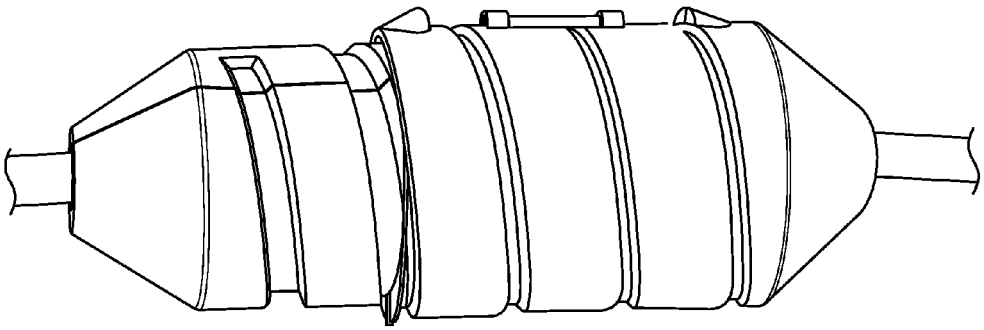
FIG. 4A (Prior Art)
FIG. 4A shows a side view of a prior art covering for an electrical cord connection.
Figure 4B:
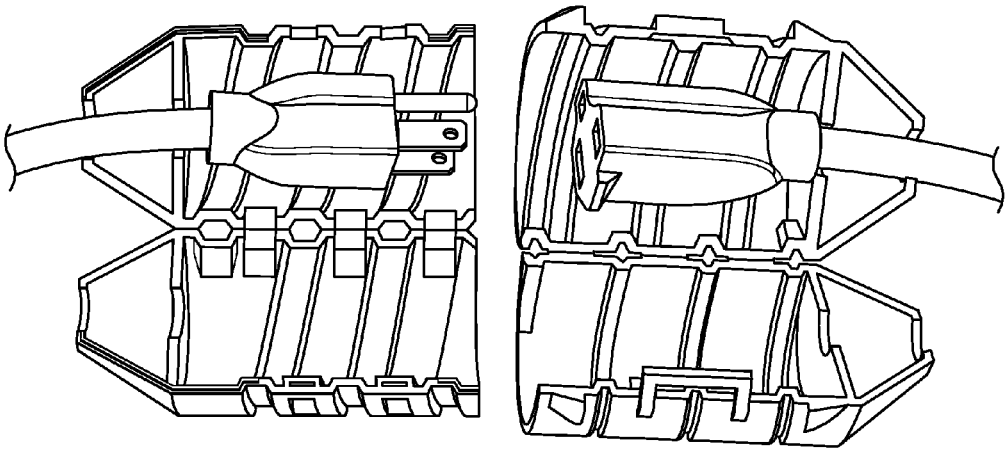
FIG. 4B (Prior Art)
FIG. 4B shows a side view of a prior art covering for an electrical cord connection.
Figure 4C:
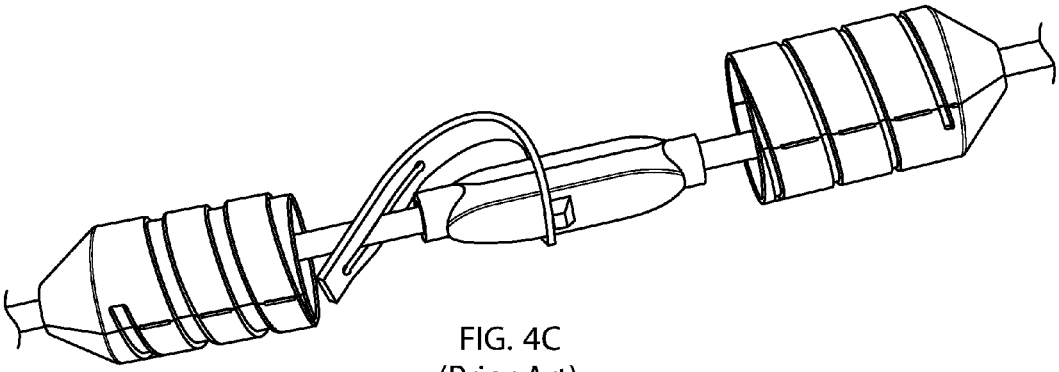
FIG. 4C (Prior Art)
FIG. 4C shows a side view of a prior art covering for an electrical cord connection.

The nubs 215 and tabs 225 may mate as a result of twisting and mating the covering portions 210, 220. Referring to FIGS. 3A-3C, as the portions 210, 220 are twisted together, a given nub 215 may force a tab 225 outwardly away from the covering portion 220. The tab 225 may then become compressed. The tab 225 may have an opening that receives the nub 215. As the nub 215 enters this opening, the tab 225 may at least partially decompress, thereby "locking" the nub 215 and tab 225. The height of the nub 215 may be approximately the same as the height of the tab 225.

The nub 215 may have a side with a shallow slope and a side with a steep slope. The shallow slope may be "shallow" in that it may be shallower than the steep slope. Similarly, the steep slope may be "steep" in that it may be steeper than the shallower slope. The shallower slope side of the nub 215 may be employed to compress the tab 225 when going from an unlocked to a locked state. This may reduce the amount of torque needed to lock the radial locking system by causing the tab 225 to more gradually compress as the nub 215 moves underneath the tab 225. The steeper slope side of the nub 215 may be employed to compress the tab 225 when going from a locked to an unlocked state. This may increase the amount of torque needed to unlock the radial locking system by causing the tab 225 to more rapidly compress as the nub 215 moves underneath the tab 225.

The radial lock(s) 215, 225 may provide for a more robust connection between the covering portions 210, 220 and may also provide feedback to a user that the covering portions 210, 220 have been connected. The radial locks 215, 225 may also discourage over-tightening of the covering portions 210, 220.

The radial locks 215, 225 may also provide structural support to prevent the covering portions 210, 220 from opening, disconnecting, or becoming damaged as a result of certain torqueing events. In one configuration, four pairs of radial locks 215, 225 may be provided at approximately 90° from each other, thereby creating two opposing sets of pairs at approximately 180° from each other. This configuration may provide additional strength by matching a pulling force on one of the locks against a pushing force of the other lock 180° away.

The first or second covering portions 210, 220 may include a hanger 226 (shown as part of second covering portion 220). The hanger 226 may facilitate hanging or attachment of the system 200 to other items or structures (for example, a nail or twine).

Figure 2A:
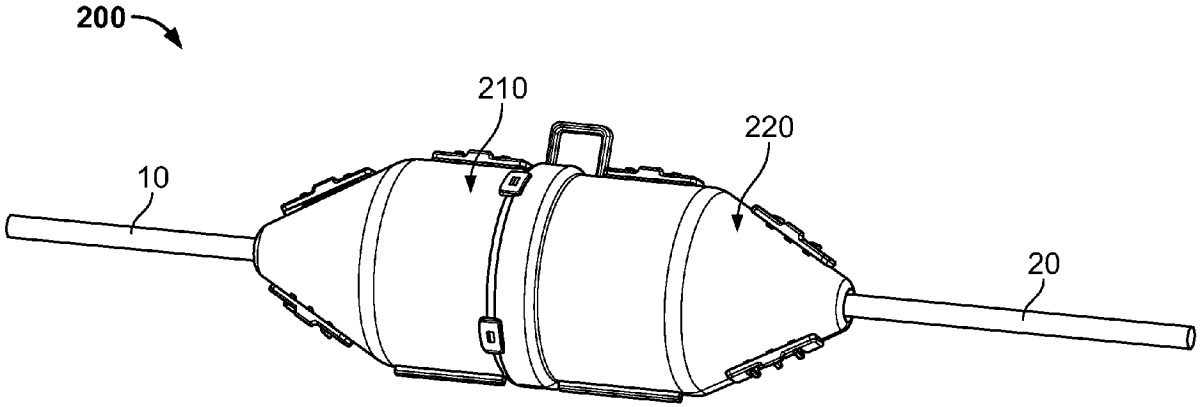
FIG. 2A shows a perspective view of a system for covering a connection of electrical cords in which two covering portions are mated, according to techniques of the present application.
Figure 2B:
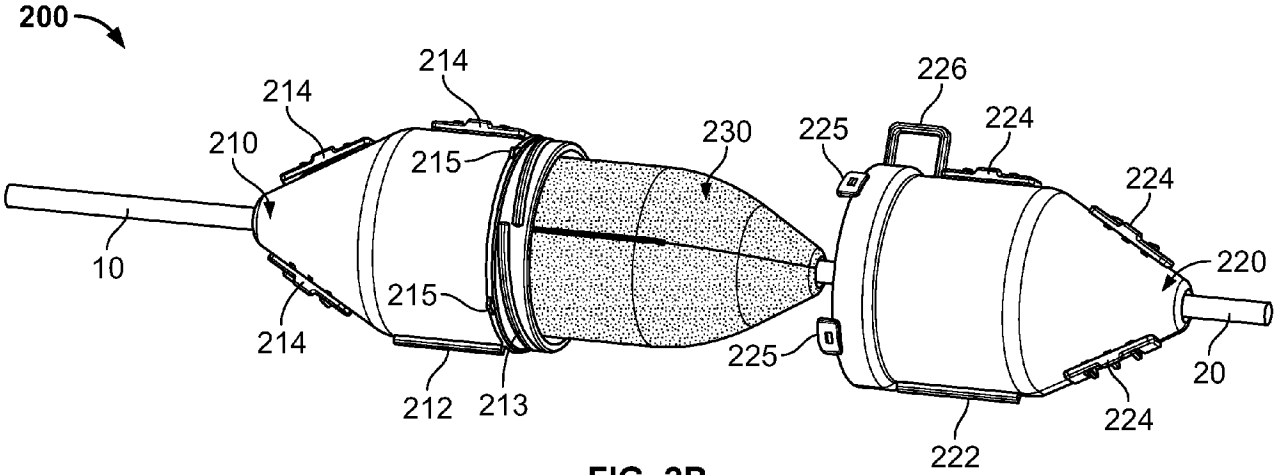
FIG. 2B shows a perspective view of a system for covering a connection of electrical cords in which two covering portions are not mated, according to techniques of the present application.
Figure 2C:
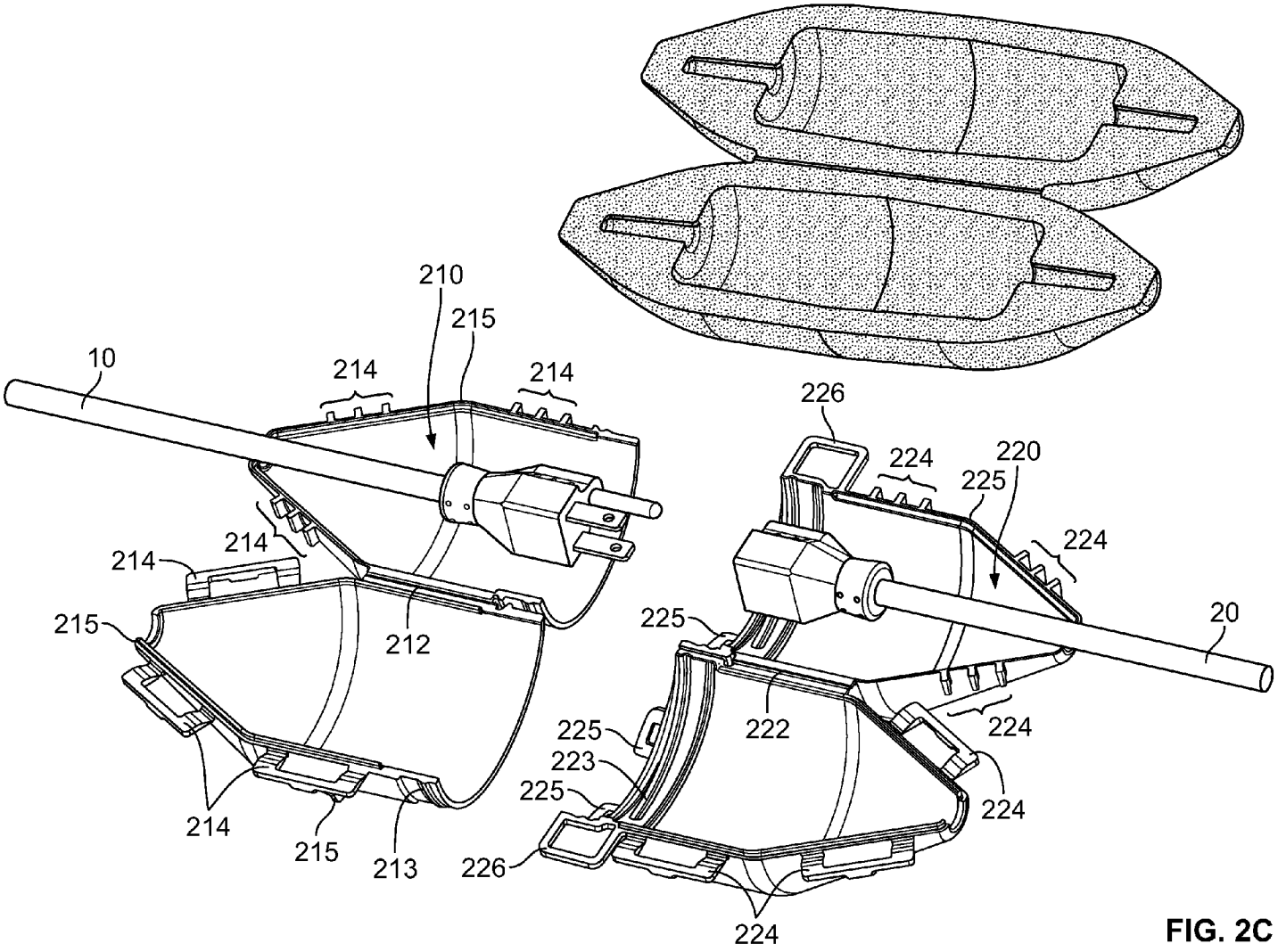
FIG. 2C shows a perspective view of a system for covering a connection of electrical cords in which two covering portions are not mated, according to techniques of the present application.

The compression portion 230 may accommodate the plugs and cords 10, 11, 20, 21, for example, with a hollow interior region. The compression portion 230 may nest (at least partially) within the interior regions of the covering portions 210, 220. The compression portion 230 may surround the portion of the cable 10 and the plug 11 of the first electrical cord accommodated by the interior region of the first covering portion 110. The compression portion 230 may be formed of two parts, such as a left and right part similar compression portion 130, 140. The compression portion 230 may be formed of a top and bottom part, either separate or connected by a hinge as shown in FIG. 2C. Such a hinge may be a living hinge, and the compression portion 230 may be formed from one piece of compressible material.

The compression portion 230 may include foam such as closed-cell foam, which may inhibit or prevent the absorption of liquids such as water. The foam may repel water, which may bead once hitting the foam and then roll off of the foam. Due to the compressibility of the foam, the compression portion 230 may be self-adjusting, thereby facilitating the formation of seals around different size cords or wires, such as 14, 16, 18, 20, 22, or 24 gauge wires or cords.

The compression portion 230 may have a density of approximately 2 lbs/ft$^3$ and a tensile strength of approximately 35 psi. The compression portion 230 may have an elongation of approximately 160% and a tear resistance of approximately 7. The compression portion 230 may have compression strengths as follows: approximately 4.5 psi at 10% deflection; approximately 7 psi at 25% deflection, approximately 11 psi at 40% deflection, and approximately 15 psi at 50% deflection. The compression portion 230 may have a compression set of approximately 16% and a thermal stability of less than approximately 3% change over 24 hours at 158° F. Such specifications may be determined according to the ASTM D3575 standard.

As shown in FIG. 2C, the hollow interior region of the compression portion 230 may have a plug-accommodating hollow region that accommodates the plugs 11, 21 and cord-accommodating hollow regions (for example, two crevices), which accommodate portions of the cords 10, 20. The cord-accommodating hollow regions may each extend from the plug-accommodating hollow region toward different ends (for example, opposite ends) of the compression portion 230.

The cord-accommodating regions may not extend all of the distance to the ends. For example, as shown in FIG. 2C, there may not be a hollow region within the compression portion 230 between one or more ends and the furthest extent of the hollow interior region (for example, the furthest extent of the cord-accommodating hollow regions). This may facilitate formation of a seal around the cords 10, 20 to form a seal to inhibit the penetration of moisture into the hollow interior region of the compressible portion 230 and towards the connection of the plugs 11, 21.

Figure 2D:
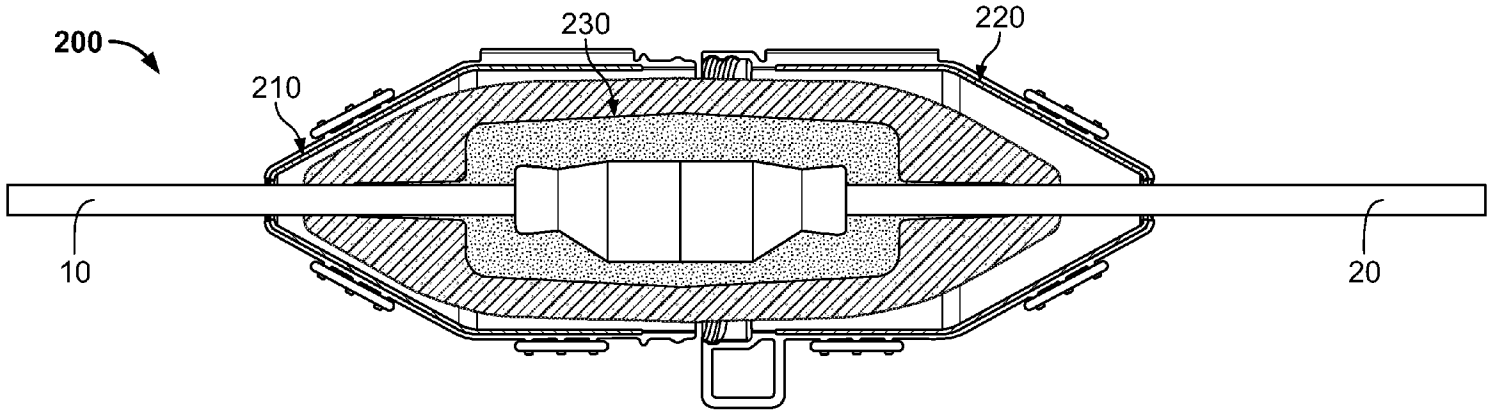
FIG. 2D shows a cross-sectional view of a system for covering a connection of electrical cords in which two covering portions are not mated, according to techniques of the present application.
Figure 2E:
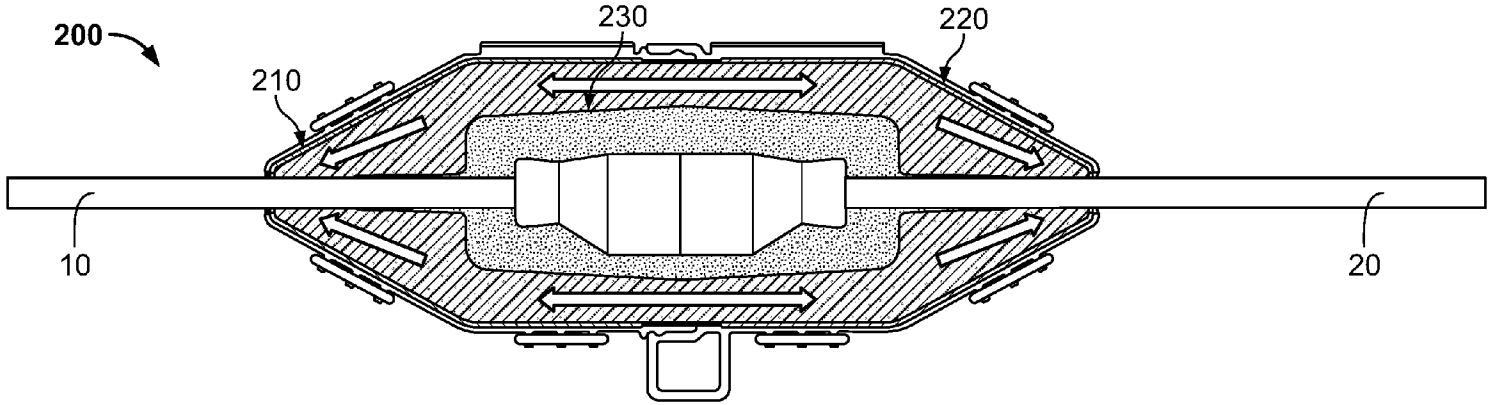
FIG. 2E shows a cross-sectional view of a system for covering a connection of electrical cords in which two covering portions are mated, according to techniques of the present application.

FIG. 2D shows a cross-sectional view of the system 200 before the covering portions 210, 220 are mated. FIG. 2E shows a cross-sectional view of the system 200 after the covering portions 210, 220 are mated. After mating via the mating portions 213 and 223, the compression portion 230 may compress (as illustrated by the arrows in FIG. 2E) and fill in voids in the interior regions of the covering portions 210, 220 (for example, near the cable apertures). This compression (for example, radial compression) may also form seals at the cable apertures.

The first and second covering portions 210, 220 may mate through mating portions 213, 223 (for example, complimentary screw threads) which screw together (for example, ¼ turn). As the covering portions 210, 220 are connected they may exert a radial compression force upon the compression portion 230 causing it to fill in the voids around the cables 10, 20 and the other openings along the compression portion 230 resulting in a substantially water or weather resistant seal around the electrical connection between the plugs 11, 21.

Though not shown, the system 200 may employ keyways, such as those shown in system 100. Furthermore, various features in either system 100 or 200 may be interchangeable or equally applicable to the other of system 100 or 200. For example, a hanger such as hanger 226 may also be employed in system 100.

The system 200 shown in FIGS. 2A-2E may be used in the following manner. The compression portion 230 has a top and bottom portion and a living clam shell hinge. The top portion and the bottom portion are opened with respect to each other, thereby revealing the hollow interior region. The cables 10, 20 and plugs 11, 21 of the first and second electrical cords are placed in the compression portion 230. The compression portion 230 is then placed in the first covering portion 210.

The first covering portion 210 is then mated with the second covering portion 220 with their respective threads 213, 223 by turning the covering portions 210, 220 ¼ turn with respect to each other. During the mating process, four nubs 215 on the first covering portion 210 force outwardly (along a radial direction) four corresponding tabs 225 on the second covering portion 220. The tabs 225 become compressed until the nubs 215 enter corresponding openings in the tabs 225. At this time, the tabs 225 decompress, thereby locking the nubs 215 and tabs 225 (and thereby locking the first covering portion 210 and the second covering portion 220).

Figure 5A:
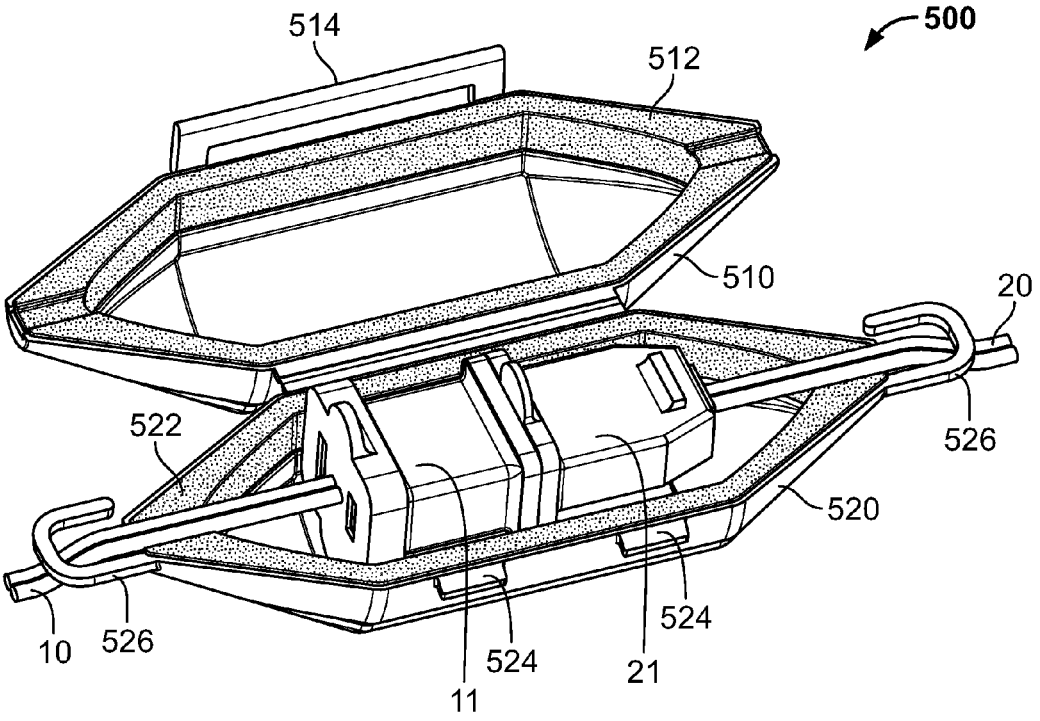
FIG. 5A shows a perspective view of a system for covering a connection of electrical cords, according to techniques of the present application.
Figure 5B:
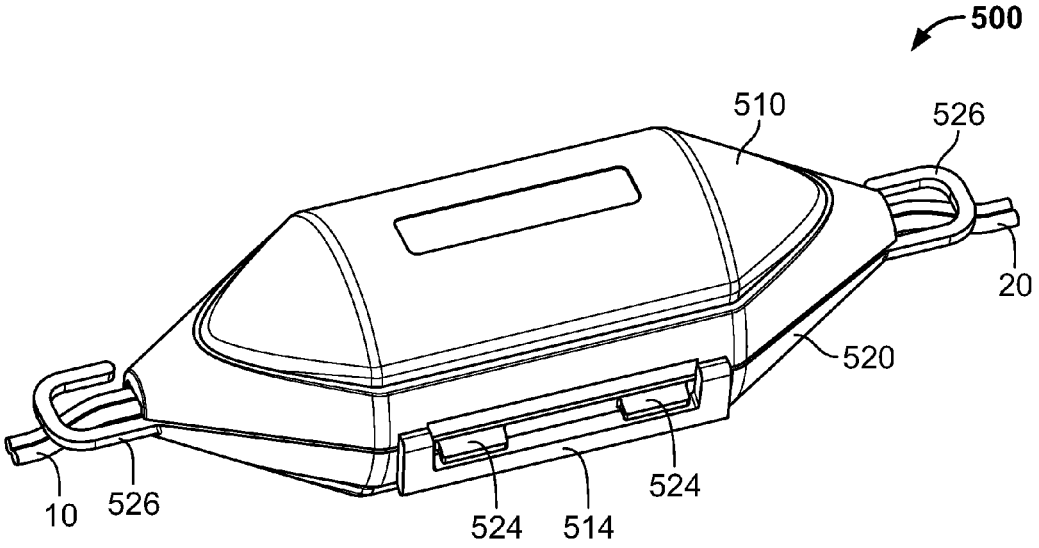
FIG. 5B shows a perspective view of a system for covering a connection of electrical cords, according to techniques of the present application.

FIGS. 5A and 5B show a system 500 for covering an electrical cord connection, according to techniques of the present application. FIG. 5A shows the system 500 in an open position and FIG. 5B shows the system 500 in a closed position. The system 500 is configured to cover the connection of the plug 11 of cord 10 with the plug 21 of cord 21. The system 500 may include a first housing portion 510 and a second housing portion 520. The housing portions 510, 520 may be plastic and may be connected via a living hinge, for example, in a clam-shell arrangement.

The first housing portion 510 may have a rim. A first compression portion 512 may be arranged around the rim. The first compression portion 512 may be arranged around the rim without covering the entire rim. For example, the first compression portion may not cover the outermost edge of the rim. The first compression portion 512 may include a material, such as a thermoplastic elastomer, silicone, rubber, foam, or cork. The first compression portion 512 may include recessed areas to accommodate cords 10, 20. The recessed areas may be located at primary axial regions of the first compression portion 512.

The second housing portion 520 may have a rim. A second compression portion 522 may be arranged around the rim. The second compression portion 522 may be arranged around the rim without covering the entire rim. For example, the second compression portion may not cover the outermost edge of the rim. The second compression portion 522 may include a material, such as a thermoplastic elastomer, silicone, rubber, foam, or cork. The second compression portion 522 may include recessed areas to accommodate cords 10, 20. The recessed areas may be located at primary axial regions of the second compression portion 522. The orientation of these recessed areas may match those of compression portion 512.

When the system 500 is in the closed position, a hollow region may be formed between the first and second housing portions 510, 520. The housing region may cover the first plug 11 and the second plug 21 when they are mated. When the first compression portion 512 and the second compression portion 522 are compressed against each other, a rim seal may be formed between the rim of the first housing portion 510 and the rim of the second housing portion 520.

In the rim seal, a first cable aperture may be formed to accommodate the first cable 10. The first cable aperture may be formed from a corresponding pair of the recessed areas in the first compression portion 512 and the second compression portion 522. The first cable aperture may compress against the first cable 10 to form a seal. The first cable aperture may be located at a primary axial end of the rim seal. A second cable aperture may be formed in the rim seal to accommodate the second cable 20. The second cable aperture may be formed from a corresponding pair of the recessed areas in the first compression portion 512 and the second compression portion 522. The second cable aperture may compress against the second cable 20 to form a seal. The second cable aperture may be located at a primary axial end of the rim seal.

The first compression portion 512 may be integrated with the first housing portion 510. Similarly, the second compression portion 522 may be integrated with the second housing portion 520. For example, such an integration may be achieved through the use of two-shot injection molding. In such a process, a first material may be injected through a primary runner system, as in a typical injection molding cycle. During the injection, the mold volume to be occupied by the second material may be shut off from the primary runner system. The mold may then be opened and the core plate rotated 180 degrees. The mold may then be closed and a secondary runner system may be connected to the volume to be filled. After sufficient cooling, the mold is opened and the part is ejected.

The system 500 may be securable in the closed position. For example, the system 500 may include locking features 514, 524. The locking feature 514 may be part of the first portion 510, and the locking feature 524 may be part of the second portion 520. The locking feature 514 may be female and the locking feature 524 may be male. The locking features 514, 524 may lockably mate with each other. The locking features 514, 524 may be snap locking features. The locking features 514, 524 may be centrally located (as depicted) or may be located towards the ends on the angled regions of the housing portions 510, 520. There may be two, three, or more sets of locking features 514, 524. For example, there may be one set in the middle and one set on each of the ends.

The system 500 may also include strain relief portions 526. The strain relief portions 526 may be a part of or integrated with the first housing portion 510 and/or the second housing portion 520. The strain relief portions 526 may be hook shaped, and may project from the primary axial ends of the first or second housing portions 510, 520. When the cords 10, 20 are placed in the recessed areas of one of the compression portions 512, 522, the cords may be fed underneath or through the strain relief portions 526. The strain relief portions 526 may exert pressure against the cords 10, 20 and may facilitate the connection of the plugs 11, 21 from being inadvertently or improperly pulled apart.

While the invention has been described with reference to certain techniques, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular technique disclosed, but that the invention will include all techniques falling within the scope of the appended claims.

The invention claimed is:

1. An electrical cord covering system for covering a connection of a first electrical cord including a first plug and a first cable with a second electrical cord including a second plug and a second cable, wherein the electrical cord covering system comprises:

a first covering portion including:

a first casing piece and a second casing piece connected by a hinge;

a first securing portion attached to the first casing piece, and a second securing portion attached to the second casing piece, wherein the first securing portion and the second securing portion are configured to mate to hold the first covering portion in a closed position;

wherein when the first covering portion is in the closed position, the first covering portion includes a hollow interior region, a cable aperture, and a plug aperture;

wherein the hollow interior region of the first covering portion is configured to accommodate a portion of the first cable and the first plug;

wherein the cable aperture of the first covering portion includes an opening between the hollow interior region of the first covering portion and a region exterior to the first covering portion, wherein the cable aperture of the first covering portion is configured to accommodate the first cable and allow the first cable to pass from the hollow interior region of the first covering portion and the region exterior to the first covering portion; and wherein the plug aperture of the first covering portion includes an opening between the hollow interior region of the first covering portion and the region exterior to the first covering portion, wherein the plug aperture of the first covering portion is configured to permit the first plug to mate with the second plug;

a first compression portion abutting the first casing, wherein the first compression portion comprises a groove configured to receive a portion of the first cable;

a second compression portion abutting the second casing piece, wherein the second compression portion comprises a groove configured to receive a portion of the first cable, wherein the first compression portion and the second compression portion are configured to engage with each other to form a channel, and wherein the channel surrounds a portion of the first cable when the first covering portion is in the closed position such that a compression seal is formed around the first cable at the cable aperture of the first covering portion;

a second covering portion including:

a third casing piece and a fourth casing piece connected by another hinge;

a third securing portion attached to the third casing piece, and a fourth securing portion attached to the fourth casing piece, wherein the third securing portion and the fourth securing portion are configured to mate to hold the second covering portion in a closed position;

wherein when the second covering portion is in the closed position, the first covering portion includes a hollow interior region, a cable aperture, and a plug aperture;

wherein the hollow interior region of the second covering portion is configured to accommodate a portion of the second cable and the second plug;

wherein the cable aperture of the second covering portion includes an opening between the hollow interior region of the second covering portion and a region exterior to the second covering portion, wherein the cable aperture of the second covering portion is configured to accommodate the second cable and allow the second cable to pass from the hollow interior region of the second covering portion and the region exterior to the second covering portion;

wherein the plug aperture of the second covering portion includes an opening between the hollow interior region of the second covering portion and the region exterior to the second covering portion, wherein the plug aperture of the second covering portion is configured to permit the second plug to mate with the first plug; and wherein the second covering portion is configured to engage with the first covering portion;

a third compression portion abutting the third casing piece, wherein the third compression portion comprises a groove configured to receive a portion of the second cable; and a fourth compression portion abutting the fourth casing piece, wherein the fourth compression portion comprises a groove configured to receive a portion of the second cable, wherein the third compression portion and the fourth compression portion are configured to engage with each other to form a channel, and wherein the channel surrounds a portion of the second cable when the second covering portion is in the closed position such that a compression seal is formed around the second cable at the cable aperture of the second covering portion.

2. The electrical cord covering system of claim 1, wherein each of the first, second, third, and fourth compression portions comprises foam.

3. The electrical cord covering system of claim 1, wherein each of the first, second, third, and fourth compression portions comprises a thermoplastic elastomer material.

4. The electrical cord covering system of claim 1, wherein each of the first, second, third, and fourth compression portions comprises rubber.

5. The electrical cord covering system of claim 1, wherein each of the first, second, third, and fourth compression portions comprises cork.

6. The electrical cord covering system of claim 1, wherein:

the hinge in the first covering portion comprises a living hinge; and the another hinge in the second covering portion comprises a living hinge.

7. The electrical cord covering system of claim 1, wherein:

the first securing portion and the second securing portion comprise a snap lock; and the third securing portion and the fourth securing portion comprise a snap lock.

8. The electrical cord covering system of claim 1, wherein:

the channel formed between the first compression portion and the second compression portion extends to an outer edge of the cable aperture of the first covering portion; and the channel formed between the third compression portion and the fourth compression portion extends to an outer edge of the cable aperture of the second covering portion.

9. The electrical cord covering system of claim 1, wherein:

the first compression portion is integrated with the first casing piece;

the second compression portion is integrated with the second casing piece;

the third compression portion is integrated with the third casing piece; and the fourth compression portion is integrated with the fourth casing piece.

* * * * *